US007777771B2

(12) United States Patent
Sakurai et al.

(10) Patent No.: US 7,777,771 B2
(45) Date of Patent: Aug. 17, 2010

(54) INFORMATION RECORDING AND ERASING APPARATUS

(75) Inventors: Hideo Sakurai, Shizuoka (JP); Tadafumi Tatewaki, Shizuoka (JP); Yukio Ide, Shizuoka (JP); Naoki Yoshida, Tokyo (JP)

(73) Assignees: Ricoh Company, Ltd., Tokyo (JP); Wedg Co., Ltd., Tokyo (JP)

( * ) Notice: Subject to any disclaimer, the term of this patent is extended or adjusted under 35 U.S.C. 154(b) by 342 days.

(21) Appl. No.: 11/832,986

(22) Filed: Aug. 2, 2007

(65) Prior Publication Data

US 2008/0062236 A1 Mar. 13, 2008

(30) Foreign Application Priority Data

Sep. 8, 2006 (JP) ..... 2006-244311

(51) Int. Cl.
*B41J 2/32* (2006.01)

(52) U.S. Cl. ..... 347/218

(58) Field of Classification Search ..... 347/171, 347/218

See application file for complete search history.

(56) References Cited

U.S. PATENT DOCUMENTS

| | | | | |
|---|---|---|---|---|
| 7,238,642 | B2 * | 7/2007 | Shimbo et al. | 503/201 |
| 7,371,708 | B2 * | 5/2008 | Arai et al. | 503/201 |
| 7,452,847 | B2 * | 11/2008 | Kuboyama et al. | 503/201 |
| 7,585,813 | B2 * | 9/2009 | Shimbo et al. | 503/201 |

FOREIGN PATENT DOCUMENTS

| | | |
|---|---|---|
| EP | 1 571 005 A1 | 9/2005 |
| GB | 2 345 348 A | 7/2000 |
| JP | 2002-234201 | 8/2002 |
| JP | 2002-337368 | 11/2002 |
| JP | 2003-94695 | 4/2003 |
| JP | 2003-94696 | 4/2003 |
| JP | 2003-94699 | 4/2003 |
| JP | 2004-98539 | 4/2004 |
| JP | 2004-160928 | 6/2004 |
| JP | 2004-268256 | 9/2004 |
| JP | 2004-345361 | 12/2004 |
| JP | 2005-43860 | 2/2005 |
| JP | 2005-47108 | 2/2005 |
| JP | 3643577 | 2/2005 |
| JP | 2005-56047 | 3/2005 |
| JP | 2005-59335 | 3/2005 |
| JP | 2005-161736 | 6/2005 |

(Continued)

*Primary Examiner*—Huan H Tran
(74) *Attorney, Agent, or Firm*—Oblon, Spivak, McClelland, Maier & Neustadt, L.L.P.

(57) ABSTRACT

An information recording and erasing apparatus configured to record information on and erase other information from a thermo-sensitive recording medium which medium is capable of heat-reversible coloring and discoloring, the information recording and erasing apparatus includes an erasing unit configured to move the thermo-sensitive recording medium from one side to another side, heat the thermo-sensitive recording medium, and erase the other information recorded in the thermo-sensitive recording medium; and a recording unit provided in a direction perpendicular to a moving direction of the thermo-sensitive recording medium with the erasing unit, the recording unit being configured to record the information in the thermo-sensitive recording medium where the other information is erased by the erasing unit.

11 Claims, 9 Drawing Sheets

FOREIGN PATENT DOCUMENTS

| | | |
|---|---|---|
| JP | 2005-262850 | 9/2005 |
| JP | 2005-305677 | 11/2005 |
| JP | 2006-150766 | 6/2006 |
| KR | 10-2004-0015079 | 2/2004 |
| WO | WO 02/092348 A1 | 11/2002 |

* cited by examiner

INFORMATION RECORDING AND ERASING APPARATUS

BACKGROUND OF THE INVENTION

1. Field of the Invention

The present invention generally relates to information recording and erasing apparatuses, and more specifically, to an information recording and erasing apparatus configured to record and erase information on or from a thermo-sensitive recording medium.

2. Description of the Related Art

Recently, in the distribution business or manufacturing processes in companies, for example, an IC (Integrated Circuit) tag or an RFID (Radio Frequency Identification) tag (RF tag) has been attached to a product to realize a technique whereby management is performed or identification of the product is automatically made. Here, the IC tag or the RF tag can read and write information from and to the outside by radio transmission.

In addition, with respect to the RF tag, since UHF band radio waves have been able to be used for the RFID transmissions since April 2005, it is expected to use the RFID in not only manufacturing in the company or distribution but also the entirety of business such as retail business.

For storing management or in distribution processes of the products, it is necessary for operators to visually check information of the products. Accordingly, these tags are used as an IC card or an RF card unified with a card main body where information recorded in the tag can also be visibly printed.

If the IC card or the RF card is mechanically damaged, information stored in the card may be lost. Therefore, it is necessary to limit card flexibility by improving rigidity of the card main body. Because of this, in a case where the information is rewritten by using a thermal printer, as discussed in Japanese Laid-Open Patent Application Publication No. 2002-234201 or Japanese Laid-Open Patent Application Publication No. 2005-56047, the card main body moves in a single direction for an erasing head and a recording head arranged in a straight line without the card main body curving so that information is erased in an upper step and information is recorded in an lower step.

However, in the method discussed in Japanese Laid-Open Patent Application Publication No. 2002-234201, the erasing unit and the recording unit are arranged in a moving direction of the card. Therefore, a supply opening for supplying the card to the apparatus and a discharge opening for discharging the card are position at opposite sides from each other. Accordingly, it is necessary to secure operations spaces at both the supply opening and the discharge opening. Furthermore, operations for the apparatus are complicated.

In addition, in the method discussed in Japanese Laid-Open Patent Application Publication No. 2005-56047, an insertion opening and a discharge opening for the card are made common. Therefore, although full front operations can be realized, it is difficult to simultaneously implement the erasing process and the recording process for plural cards. Hence, it takes a long time for continuously rewriting the information to the card.

SUMMARY OF THE INVENTION

Accordingly, embodiments of the present invention may provide a novel and useful information recording and erasing apparatus solving one or more of the problems discussed above.

More specifically, the embodiments of the present invention may provide an information recording and erasing apparatus whereby operability and process speed can be improved without making the size of the apparatus large.

One aspect of the present invention may be to provide an information recording and erasing apparatus configured to record information on and erase other information from a thermo-sensitive recording medium which medium is capable of heat-reversible coloring and discoloring, the information recording and erasing apparatus including:

an erasing unit configured to move the thermo-sensitive recording medium from one side to another side, heat the thermo-sensitive recording medium, and erase the other information recorded in the thermo-sensitive recording medium; and a recording unit provided in a direction perpendicular to a moving direction of the thermo-sensitive recording medium with the erasing unit, the recording unit being configured to record the information in the thermo-sensitive recording medium where the other information is erased by the erasing unit.

Other objects, features, and advantages of the present invention will be come more apparent from the following detailed description when read in conjunction with the accompanying drawings.

DETAILED DESCRIPTION OF THE PREFERRED EMBODIMENTS

A description is given below, with reference to the FIG. 1 through FIG. 10 of embodiments of the present invention.

First, an embodiment of the present invention is discussed with reference to FIG. 1 through FIG. 6B.

Figure 1:
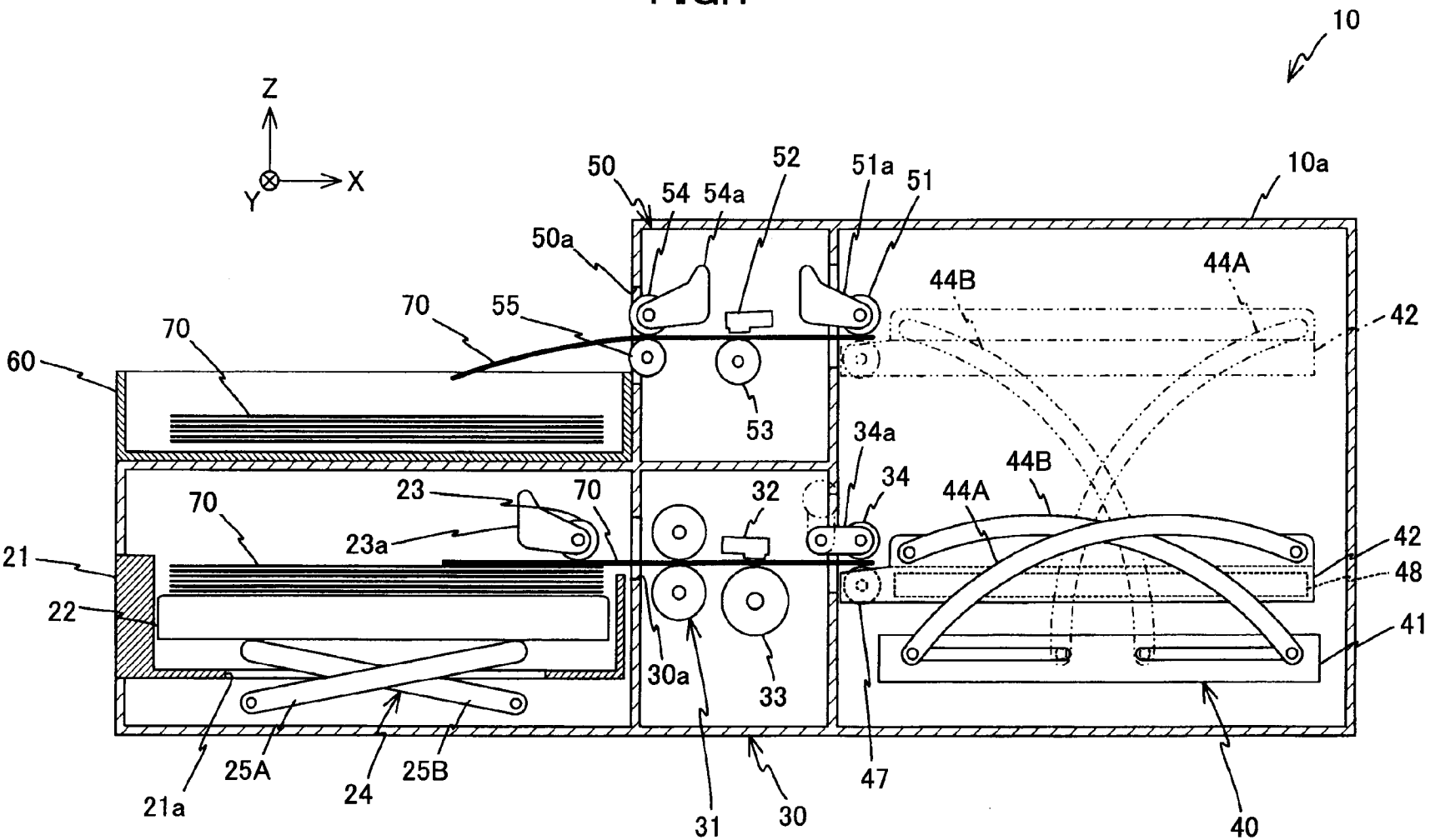
FIG. 1 is a schematic view of a printer 10 of an embodiment of the present invention.

FIG. 1 is a schematic view of a printer 10 of an embodiment of the present invention. The printer 10 shown in FIG. 1 is a thermal printer configured to erase and record information from and in a recording card 70, for example. As shown in FIG. 1, the printer 10 includes a erasing unit 30, a recording unit 50, a lifter 40, a paper feeding cassette 21, a lifting mechanism 24, a paper feeding roller 23, a paper discharge tray 60, and a housing 10*a* where the erasing unit 30, the recording unit 50, the lifter 40, the paper feeding cassette 21, the lifting mechanism 24, the paper feeding roller 23, and the paper discharge tray 60 are received.

Figure 2:
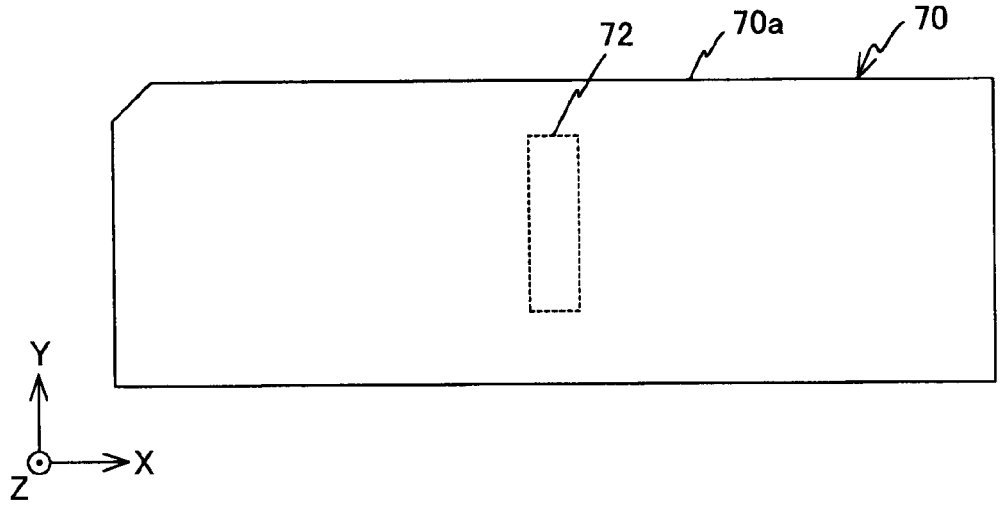
FIG. 2 is a view showing a recording card 70.

FIG. 2 is a view showing a recording card 70. As shown in FIG. 2, the recording card 70 includes a card main body 70*a* whose longitudinal direction is an x-axial direction and an RF tag 72 installed in the card main body 70*a*.

The card main body 70*a* is made of a base material and a recording material formed on an upper surface of the base material, namely a surface at the +Z side. The RF tag 72 is sandwiched by the base material and the recording material in the substantially center of the upper surface of the base material.

The recording material is a thermo-sensitive recording medium where a thermal head can perform discoloring and coloring. Relative coloring is performed based on a difference of heating temperatures and cooling rates after heating.

Figure 3:
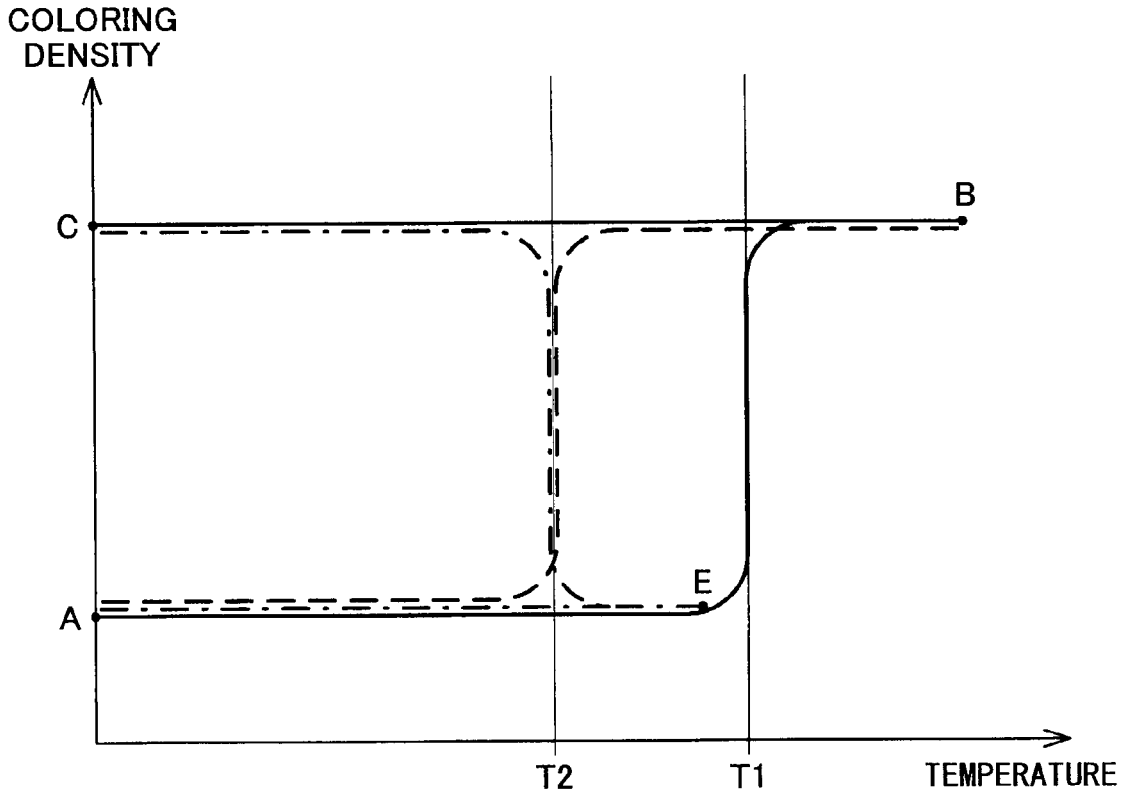
FIG. 3 is a graph showing temperature characteristics of the recording card 70.

FIG. 3 is a graph showing temperature characteristic of the recording card 70. More specifically, FIG. 3 shows the relationship between temperature and coloring density of this recording material.

As shown in FIG. 3, for example, when temperature of the thermo-sensitive recording medium in a discoloring state A is increased, coloring is started in the vicinity of temperature T1 as shown by a solid line in the graph. When the temperature reaches the temperature T1, the thermo-sensitive recording medium is in a coloring state B.

When the thermo-sensitive recording medium in the coloring state B is rapidly cooled, a coloring state C is maintained as shown by a solid line in the graph. In addition, when the thermo-sensitive recording medium in the coloring state B is gradually cooled, as shown by a dashed line in the graph, discoloring happens during gradual cooling as shown by the dashed line in the graph so that the thermo-sensitive recording medium returns to the discoloring state A.

On the other hand, when the temperature of the thermo-sensitive recording medium in the coloring state C is increased again, as shown by a one dotted line, discoloring happens at a temperature T2 lower than the temperature T1 so that the thermo-sensitive recording medium is in the discoloring state E. When the temperature of the thermo-sensitive recording medium in the discoloring state E is decreased again, the thermo-sensitive recording medium returns to the discoloring state A.

Thus, by heating the upper surface of the recording card 70 by using the erasing head 32, it is possible to erase the information. In addition, by the heating the upper surface of the recording card 70 by using the recording head 52, it is possible to print (write) the information.

Referring back to FIG. 1, an upper part of the paper feeding cassette 21 is opened. The paper feeding cassette 21 is a box-shaped member where an opening 21*a* is provided on a bottom wall. A tray 22 is configured to move in the Z axial direction inside the paper feeding cassette 21.

The recording card 70 is mounted on the tray 22 and the longitudinal direction of the recording card 70 is the X axial direction. When the paper feeding cassette 21 is inserted in the housing 10*a*, the tray 22 is energized and moved by the lifting mechanism 24 to an upper part via the opening 21*a* of the paper feeding cassette 21. The lifting mechanism 24 has a pair of stick-shaped members 25A and 25B as booms that rotate with respect to an axis parallel with the Y-axis where the −X side end and the +X side end are centers so as to hoist the tray 22.

Under this structure, the recording card situated at the top of the recording cards 70 mounted on the tray 22 is pressed by a lower surface of the paper feeding roller 23 supported by the supporting member 23*a*. The paper feeding roller 23 is rotated so that the recording card 70 is supplied inside the erasing unit 30 via an insertion opening 30*a*.

The erasing unit 30 includes conveyance rollers 31, an erasing head 32, a platen roller 33, and a movable roller 34.

The conveyance roller 31 provided in upper and lower directions convey the recording card 70 sent from the paper feeding cassette 21 via the insertion opening 30*a*, in the +X direction. The erasing head 32 is provided at the +X side of the conveyance rollers 31 and is supported and can be lifted by a supporting member not shown in FIG. 1. The platen roller 33 is provided below the erasing head 32. The movable roller 34 is provided at the +X side of the erasing head 32 via a movable member 34*a*.

In the erasing unit 30, when the recording card 70 is sent, while the recording card 70 is moved in the +X direction by the conveyance rollers 31, the erasing head 32 comes in contact with an upper surface of the recording card 70 supported from a lower part by the platen roller 33.

By heating the upper surface of the recording card 70 by using the erasing head 32 so that the temperature becomes equal to or lower than the temperature T2 indicated in FIG. 3, the information recorded in the recording card 70 is erased. Operations of the movable roller 34 are discussed below.

The recording unit 50 is provided above the erasing unit 30, namely at the +Z side of the erasing unit 30. The recording unit 50 includes a recording head 52, a platen roller 53, a drawing roller 51, and first and second discharge rollers 54 and 55.

The recording head 52 is supported by a supporting member not shown in FIG. 1 so as to be able to be lifted. The platen roller 53 is provided below the recording head 52.

The drawing roller 51 is provided at the +X side of the recording head 52. The drawing roller 51 draws the recording card 70, conveyed from the erasing unit 30 by the lifter 40, between the recording head 52 and the platen roller 53. The first and second discharge rollers 54 and 55 are provided at the −X side of the recording head 52 so as to contact each other in upper and lower directions.

In the recoding unit 50, when the −X side end of the recording card 50 is drawn between the recording head 52 and the platen roller 53, in a state where the recording head 52 comes in contact with the upper surface of the recording head 70 supported from a lower side by the platen roller 33, while the recording card 70 is sent in the −X direction by the platen roller 53, the upper surface of the recording head 50 is heated so that the temperature becomes equal to or greater than the temperature T1. Thus, the information is printed.

On the other hand, the drawing roller 51 and the first discharge roller 54 are provided via supporting members 51*a* and 54*a* which can be moved in upper and lower directions by driving mechanism not shown in FIG. 1. The drawing roller 51 and the first discharge roller 54 are situated, during printing, in positions where the drawing roller 51 and the first discharge roller 54 do not interfere with the recording card 70.

When printing information is finished, the first discharge roller 54 comes in contact with the upper surface of the recording card 70 so that the recording card 70 is sandwiched between the first and second discharge rollers 54 and 55 and the second discharge roller 55 is rotated. As a result of this, the recording cards 70 are discharged, in order, to the paper discharge tray 60 via the discharge opening 50*a* formed in the housing 10*a*. Operations of the drawing roller 51 are discussed below.

Figure 4:
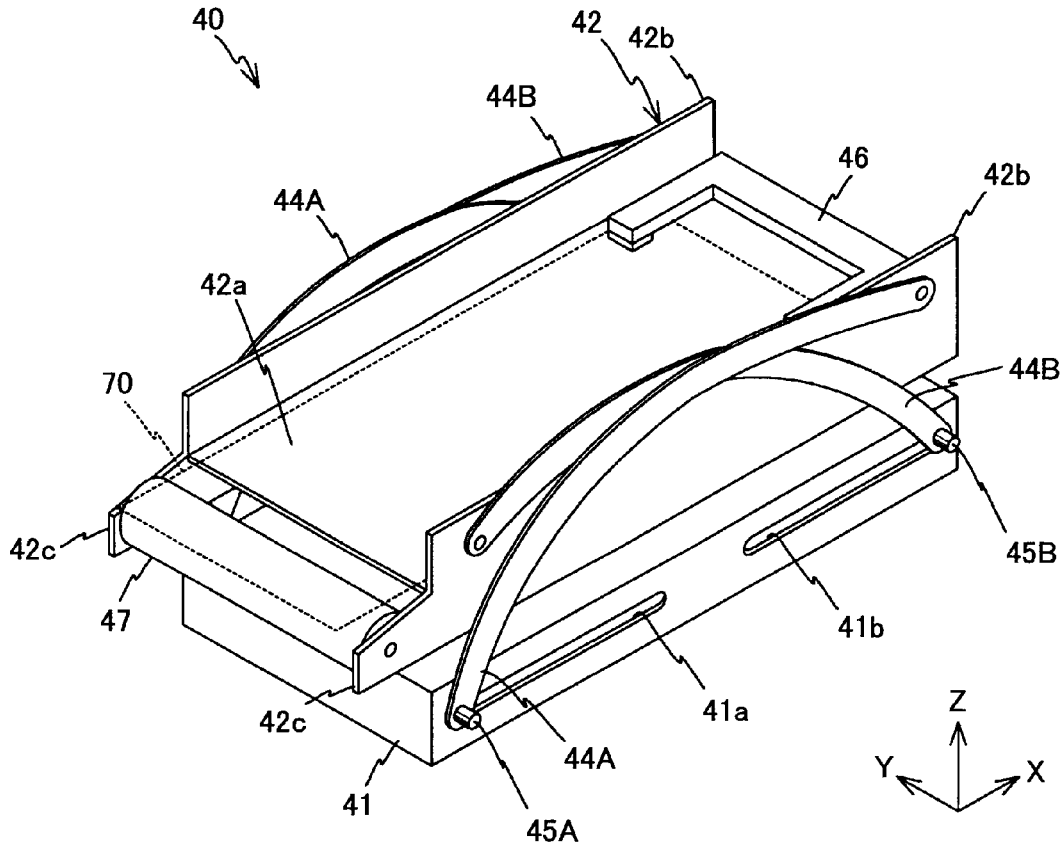
FIG. 4 is a perspective view of a lifter 40.
Figure 5:
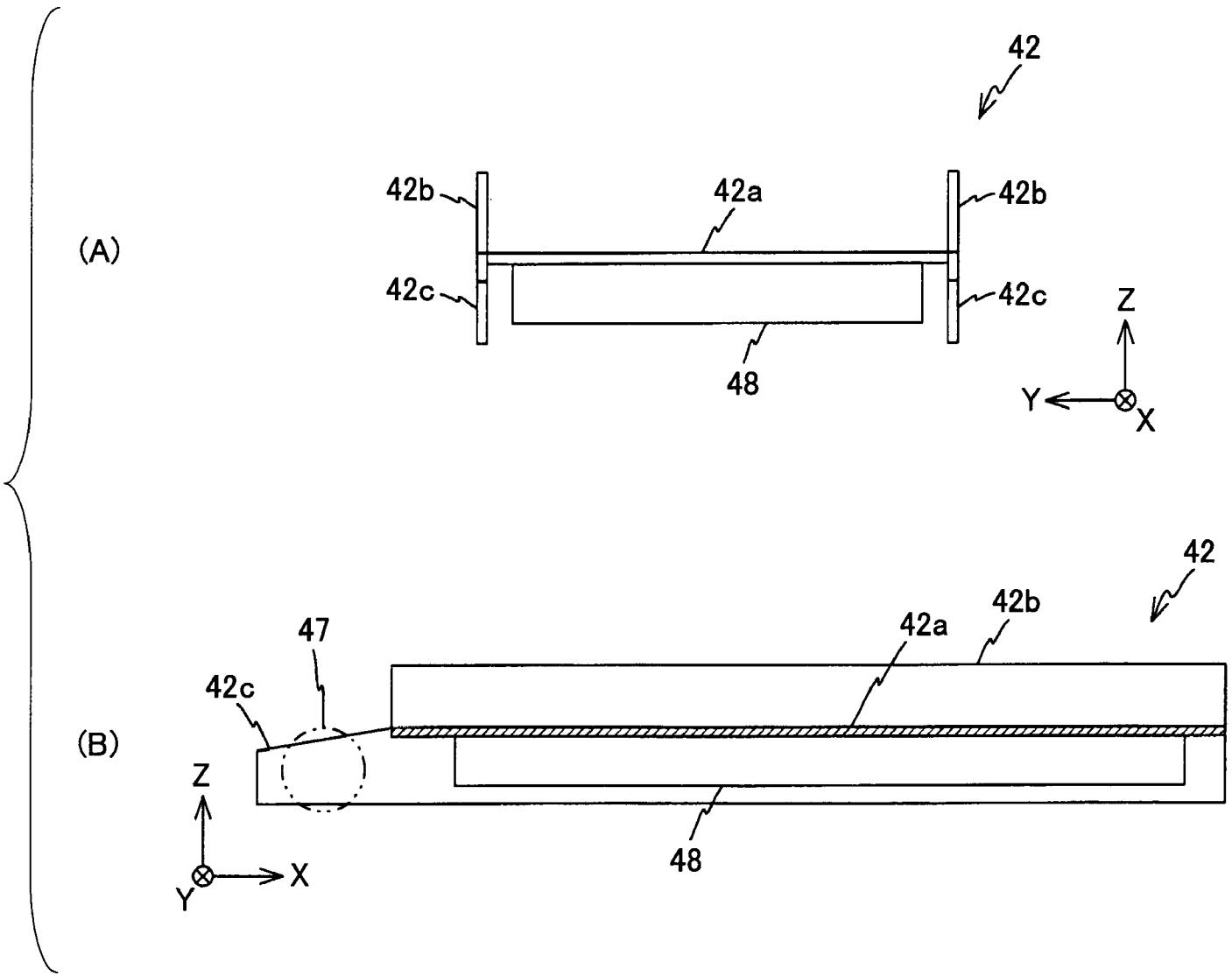
FIG. 5A is a view of a conveyance tray 42 seen from the −X side.
FIG. 5B is a view of the conveyance tray 42 seen from the −Y side.

FIG. 4 is a perspective view of a lifter 40.

As shown in FIG. 1 and FIG. 4, the lifter 40 situated inside the housing 10*a* includes a lifting mechanism 41, a conveyance tray 42, a clamper 46, an RFID unit 48 (see FIG. 5), and a conveyance roller 47.

The rectangular parallelepiped-shaped lifting mechanism 41 is arranged at the +X side of the erasing unit 30. The conveyance tray 42 is connected to the lifting mechanism 41 via a pair of link bars 44A and a pair of link bars 44B. The clamper 46 clamps the recording card 70 mounted on the conveyance tray 42. The RFID unit 48 reads and writes information from and on the RF tag 72 of the recording card 70 mounted on the conveyance tray 42. The conveyance roller 47 is provided in the vicinity of the −X side edge part of the conveyance roller 42 in a state where the longitudinal direction of the conveyance roller 47 is a Y axial direction.

The lifting mechanism 41 is provided on a bottom wall surface of the housing 10*a* via a supporting member not shown in a state where the longitudinal direction of the lifting mechanism 41 is the X axial direction.

A moving shaft 45A and a moving shaft 45B are provided at the −Y side surface of the lifting mechanism 41. The moving shaft 45A moves along a guiding elongated hole 41*a* formed in the X axial direction, namely a longitudinal direction from the −X side edge part to a center part. The moving shaft 45B moves along a guiding elongated hole 41*b* formed in the X axial direction, namely a longitudinal direction from the +X side edge part to a center part.

Similarly, a moving shaft 45A and a moving shaft 45B are provided at the −Y side surface of the lifting mechanism 41. The moving shaft 45A moves along a guiding elongated hole 41*a* formed in the X axial direction, namely a longitudinal direction from the −X side edge part to a center part. The moving shaft 45B moves along a guiding elongated hole 41*b* formed in the X axial direction, namely a longitudinal direction from the +X side edge part to a center part.

While the guiding elongated holes 41*a* and 41*b* formed in the surface at the −Y side and the moving shafts 45A and 45B are not shown, the moving shafts 45A and 45B situated at the +Y side and the −Y side of the lifting mechanism 41 are moved in synchronization in the +X direction and the −Y direction by a driving mechanism not shown.

FIG. 5A is a view of the conveyance tray 42 seen from the −X side. FIG. 5B is a view of the conveyance tray 42 seen from the −Y side.

As shown in FIG. 5A and FIG. 5B, the conveyance tray 42 includes a mounting part 42*a*, a pair of side wall parts 42*b*, and a pair of roller supporting parts 42*c*.

The longitudinal direction of the rectangular plate-shaped mounting part 42*a* is an X axial direction. The side wall parts 42*b* having longitudinal direction in the X axial direction are provided at the −Y side end and the −X side end of the mounting part 42*a* so as to be perpendicular to an upper surface of the mounting part 42*a*. The roller supporting parts 42*c* extend from the −X side edge of the side wall parts 42*b* in the −X direction.

As shown in FIG. 5A and FIG. 5B, the RFID unit 48 is fixed to a lower surface of the mounting part 42*a* provided in the conveyance tray 42. The RFID unit 48 reads and writes information from and on the RF tag 72 of the recording card 70 mounted on the upper surface of the mounting part 42*a*.

In the following explanation, reading information from the RF tag 72 is called reading information from the recording card 70. Writing information on the RF tag 72 is called writing information on the recording card 70.

The +Y side part and the −Y side part of the conveyance rollers 47 are rotatably supported by a pair of roller supporting parts 42*c* provided at the conveyance tray 42 so that the height of the upper surfaces of the conveyance roller 47 is substantially the same as the height of the upper surface of the mounting part 42*a*.

In addition, the conveyance roller 47 can be rotated with respect to a shaft parallel with the Y axis by a driving mechanism not shown. The conveyance rollers 47 can be rotated in a normal rotation (clockwise direction in FIG. 1) and in a reverse rotation (counterclockwise in FIG. 1).

As shown in FIG. 4, the damper 46 is a U-shaped member having a rotating member parallel with the Y axis and a pair of clamp parts extending from +Y side end part and −y side end part of the rotating part in the +X direction.

The rotating part of the damper 46 is supported at the +X side end part on the upper surface of the mounting part 42*a* of the conveyance tray 42 so as to be capable of rotating with respect to an axis parallel with the Y axis. The rotating part of the damper 46 is rotated by a driving mechanism not shown so that the recording card 70 mounted on the mounting part 42*a* can be sandwiched between the upper surface of the mounting part 42*a* and the pair of clamp parts.

Each of a pair of the link bars 44A has a convex curved configuration and is provided at the +Y side and −Y side of the conveyance tray 42 and the lifting device 41.

The +X side end of the link bar 44A is provided above the +X side end part of a pair of side wall parts 42*b* provided in the conveyance tray 42 so as to be capable of rotating with respect to an axis parallel with the Y axis. The −X side end of the link bar 44A is provided at the moving shaft 45A provided at the lifting device 41 so as to be capable of rotating with respect to an axis parallel with the Y axis.

The link bar 44B has the same structure as that of the link bar 44A.

That is, the −X side end of the link bar 44B is provided above −X side end part of a pair of side wall parts 42*b* provided in the conveyance tray 42 so as to be capable of rotating with respect to an axis parallel with the Y axis. The +X side end of the link bar 44B is provided at the moving shaft 45B provided at the lifting device 41 so as to be capable of rotating with respect to an axis parallel with the Y axis.

In the above-discussed lifter 40, by the lifting mechanism 41, the moving shaft 45A is moved in the −X direction and the moving shaft 45B is moved in the +X direction so that the conveyance tray 42 goes down and is positioned as indicated by a solid line in FIG. 1. By the lifting mechanism 41, the moving shaft 45A is moved in the +X direction and the moving shaft 45B is moved in the −X direction so that the conveyance tray 42 goes up and is positioned as indicated by a virtual line in FIG. 1.

Here, for the convenience of explanation, a position of the conveyance tray 42 indicated by the solid line in FIG. 1 is defined as a taking-in position. A position of the conveyance tray 42 indicated by the virtual line in FIG. 1 is defined as a taking-out position.

Figure 6:
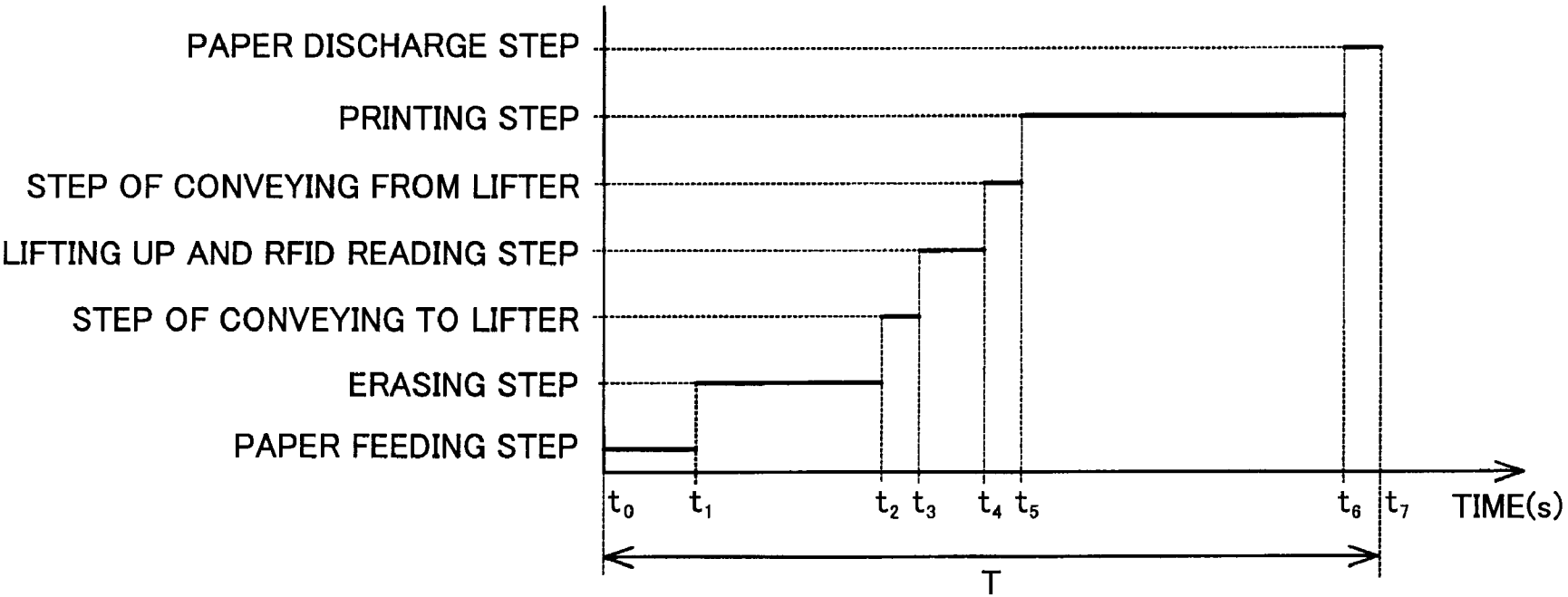
FIG. 6 is a timing chart of the printer 10.
Figure 7:
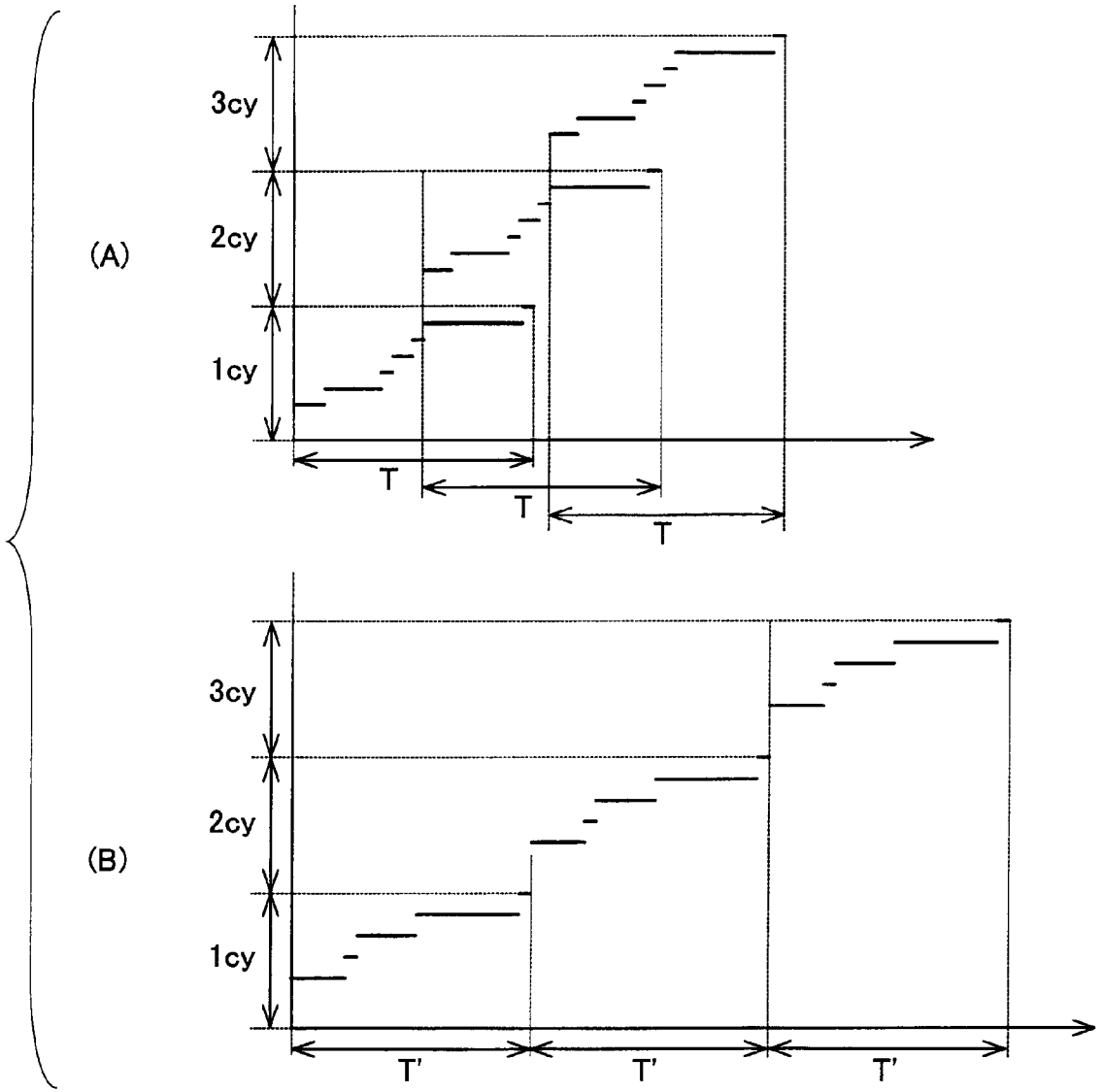
FIG. 7A is a first graph for explaining a process time in a case where printing is performed on plural recording cards 70.
FIG. 7B is a second graph for explaining a process time in a case where printing is performed on plural recording cards 70.

In the above-discussed printer 10, as shown in FIG. 6, a step of printing information in the recording card 70 is performed after seven steps, namely a paper feeding step, an erasing step, a step of conveying to the lifter, a lifting up and RFID reading step, a step of conveying from the lifter, a printing step and a paper discharge step.

If printing is done in a state where the recording card 70 remains heated during the erasing step, the printed part is not quickly cooled but gradually cooled. Hence, it may not be possible to obtain a sufficient coloring density.

In order to solve such a problem, a time for naturally cooling the recording card 70 may be provided between the erasing step and the printing step. A long conveyance section may be provided between the erasing unit 30 and the recording unit 50 may be provided so that the printed part is cooled by heat conduction to the conveyance roller or the like. However, these cases may not be preferable because the processing time may become long or the size of the apparatus may be made large.

In order to solve such a problem of thermo-sensitive recording, it is preferable to implement forced cooling for the recording card 70 between the erasing step and the printing step or just after the printing step. In order to implement forced cooling for the recording card 70, a part of the conveyance path is cooled and the conveyed recording card may be come in contact with the part. Alternatively, the recording card 70 may be come in contact with a cooling wind such as the atmosphere. Forced cooling is not limited to this as long as a heat energy obtained in the erasing step is dissipated and the temperature of the recording card 70 can be decreased.

In addition, there is no limitation of cooling the recording card 70 as long as the cooling is implemented between the erasing step and the printing step or just after the recording step. As concrete cooling means, a cooling fan, a metal block, a heat pipe, a Peltier element, or the like can be used.

Furthermore, more specifically, it is preferable that the lifter 40 be a metal block, an electric current is carried to the lifter 40 so that the inside of the housing 10*a* is equal to or lower than atmospheric temperature, and a cooling fan is provided at an upper part of the housing 10*a* so that the recording card 70 provided on the lifter is cooled. However, as long as the recording card 70 is cooled, the cooling way is not limited to the above-mentioned means.

Next, operations of the printer 10 are discussed with reference to FIG. 1. Plural recording cards 70 are received in the paper feeding cassette 21 in advance and the tray 22 is energized in an upper direction by the lifting mechanism 24.

In addition, the conveyance tray 24 is positioned as indicated by a solid line in FIG. 1, and each part of the printer 10 is controlled by a control device not shown in FIG. 1.

<Paper Feeding Step>

When the control device not shown in FIG. 1 receives a working command from a user or a senior device, the control device rotates the paper feeding roller 23 so that the recording card 70 received in the paper feeding cassette 21 is sent in the +X direction.

As a result of this, the recording card 70 is conveyed, via the insertion opening 30*a*, between the pair of conveyance rollers 31 of the erasing unit 30.

<Erasing Step>

When the recording card 70 is conveyed to the erasing unit 30, the control device moves the recording card 70 in the +X direction by using the conveyance rollers 31 and the platen roller 33. In addition, the control device heats the upper surface of the recording card 70 so as to erase information, by using the erasing head 32.

<Conveying Step to the Lifter>

When the recording card 70 is moved in the +X direction and the +X side end part of the recording card 70 passes through above the conveyance roller 47 of the conveyance tray 42, the control device rotates the movable member 34*a* so as to make the movable roller 34 come in contact with the upper surface of the recording card 70.

The control device rotates the movable roller 34 and the conveyance roller 47 so as to convey the recording card 70 to the upper part of the mounting part 42*a* of the conveyance tray 42.

As a result of this, as shown in a dotted line in FIG. 4, the recording card 70 is mounted on the conveyance tray 42 in a state where the −X side end part of the recording card 70 is positioned above the conveyance roller 47.

<Lift up and RFID Reading Step>

When the recording card 70 is conveyed in the conveyance tray 42, the control device clamps the recording card 70 with the clamper 46 and starts lifting up the conveyance tray 42 by using the lifting mechanism 41.

Furthermore, in parallel with this, reading and writing information is started from and on the recording card 79 by the RFID unit 48. At this time, reading and writing may be performed continuously or plural operations such as "reading, writing and reading in order" may be done. In the following explanation, the reading step includes such plural operations.

<Conveying Step from the Lifter>

When the conveyance tray 42 is positioned in a conveying out position, the control device drives the supporting member 51*a* so as to make the drawing roller 51 come in contact with the upper surface of the recording card 70. In addition, the control device rotates the drawing roller 51 and the conveyance roller 47 so as to convey the −X side end of the recording card 70 between the recording head 52 and the platen roller 53.

<Printing Step>

When the recording card 70 moves in the −X direction so that a recording starting position of the recording card 70 is situated just under the recording head 52, the control device lowers the recording head 52 so that the recording card 70 is sandwiched by the recording head 52 and the platen roller 53.

In addition, the control device drives the supporting members 51*a* and 54*a* in the upper direction so that the drawing roller 51 and the first discharge roller 54 are moved in a position where the drawing roller 51 and the first discharge roller 54 do not interfere with the recording card 70.

The recording card 70 is moved relative to the recording head 52 by only the platen roller 53 so that printing information based on, for example information read via the RFID unit 48 or information being input in advance by the user is started in the recording card 70.

In addition, in parallel with the above-mentioned operation, when printing in the recording card 70 is started, the control device moves the conveyance tray 42 to the conveying-in position and makes it wait. In the recording card 70, printing is started in a state where the drawing roller 51 and the first discharge roller 54 are moved to positions that do not interfere with the recording card 70.

As a result of this, it is possible to avoid removal of the recording card 70 from between the drawing roller 51 and the conveyance roller 47 and avoid a change of load due to entry of the recording card 70 between the first and second discharge rollers 54 and 55 during the moving operations of the recording card 70. Hence, it is possible to prevent generation of printing shift or a line on the recording surface of the recording card 70.

<Paper Discharge Step>

The recording cards 70 where printing is completed are discharged from the first and second discharge rollers 54 and 55 via the discharge opening part 50*a* so as to be stacked in the paper discharge tray 60 in order.

As discussed above, in the printer of this embodiment, the lifter 40 is provided at the +X side of the recording unit 50 and the erasing unit 30. Therefore, the erasing unit 30 and the recording unit 50 are arranged so as to neighbor each other in a direction perpendicular to the moving direction of the recording card 70. Accordingly, it is possible to make the size of the apparatus small in this embodiment as compared to a case where the erasing unit and the recording unit are arranged so as to neighbor each other in the moving direction of the recording card 70.

In addition, the insertion opening for conveying the recording card 70 to the erasing unit 30 and the discharge opening 50*a* for discharging the recording card 70 from the recording unit 50 are arranged so as to neighbor each other at a side of the erasing unit 30 and the recording unit 50. Hence, it is possible to improve operability of the apparatus.

Furthermore, according to the printer 10 of this embodiment, the erasing unit 30 and the recording unit 50 are arranged in upper and lower directions. Therefore, an erasing route for erasing information while the recording card 70 is sent in the +X direction and a recording route for printing information while the recording card 70 is sent in the −X direction are separately provided in the upper and lower directions. Accordingly, the erasing step by the erasing unit 30 and the recording step by the recording unit 50 can be performed in parallel. Hence, it is possible to drastically reduce the recording time for plural recording cards 70.

The following explanations are made with reference to FIG. 1, FIG. 6, FIG. 7(A), FIG. 7(B), and FIG. 10.

As discussed above, a process in the printer 10 for the recording card 70 includes seven steps shown in FIG. 6.

The paper feeding step is started at time t0. A process moves from the paper feeding step to an erasing step at time t1. A process moves from the erasing step to a step of conveying to the lifter at time t2. A process moves from the step of conveying to the lifter to a lifting up and RFID reading step at time t3.

A process moves from the lifting up and RFID reading step to a step of conveying from the lifter at time t4. A process moves from the step of conveying from the lifter to a printing step at time t5. A process moves from the printing step to a paper discharge step at time t6. The paper discharge step is ended at time t7 so that all the operations for the recording card 70 are completed.

Here, for the convenience of explanation, the steps at t0 through t7 are defined as one cycle and the times from t0 through t7 are defined as T.

On the other hand, in the printer discussed in the above-mentioned Japanese Laid-Open Patent Application Publication No. 2002-234201, the erasing route and the recording route are provided in the same straight line so that, for example, the RFID reading step is performed in a state where the recording card 70 is mounted on the paper feeding tray.

Figure 10:
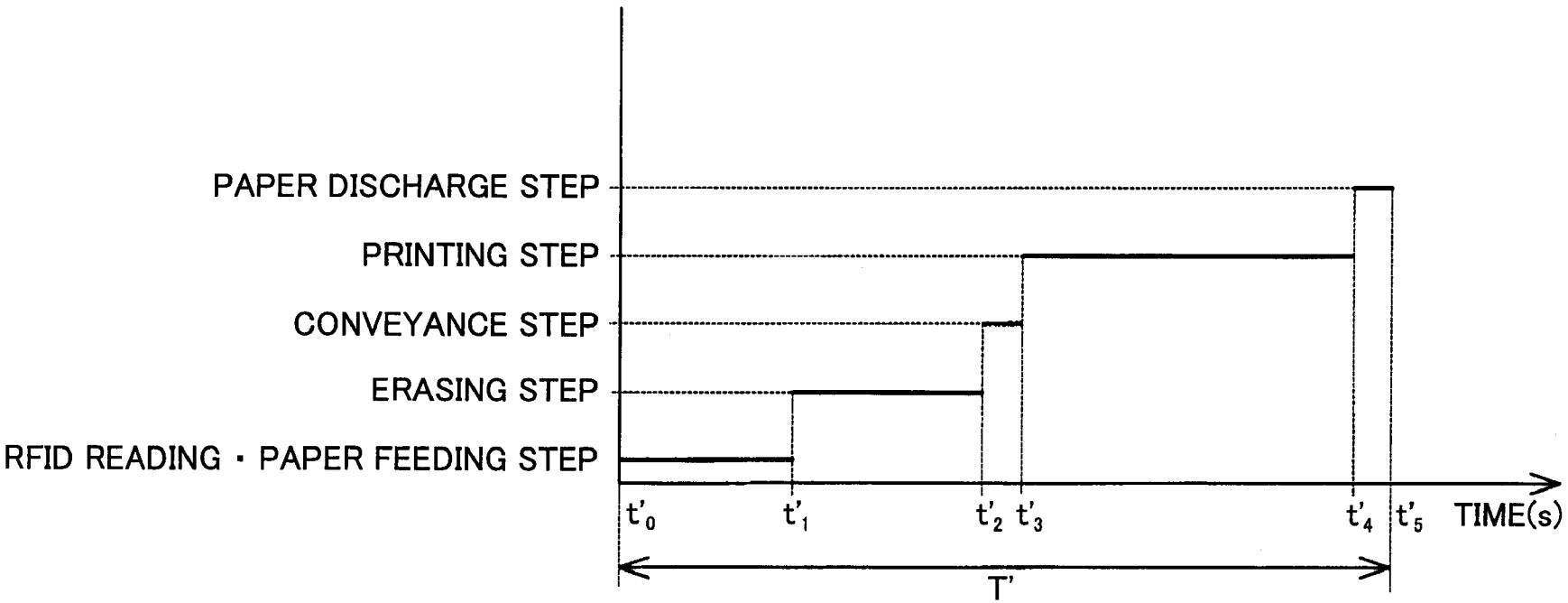
FIG. 10 is a timing chart of a conventional type printer.

In this printer, as shown in FIG. 10, the information is read and written from and on the RF tag of the recording card. A process in this printer includes five steps, that are an RFID reading and paper feeding step of feeding a paper to the erasing unit, an erasing step of erasing information of the recording card, a conveyance step of conveying the recording card where information is erased to the recording unit, a printing step of printing information on the recording card, and a paper discharge step of discharging the recording card from the recording unit.

In addition, the RFID reading and paper feeding steps are started at time t0'. A process moves from the RFID reading and paper feeding step to an erasing step at time t1'. A process moves from the erasing step to a step of conveyance step at time t2'. A process moves from the conveyance step to a printing step at time t3'.

A process moves from the printing step to a paper discharge step at time t4'. The paper discharge step is ended at time t5' so that all the operations for the recording card are completed.

Here, for the convenience of explanation, step at t0' through t5' are defined as one cycle and the times from t0' through t5' are defined as T'. The time period T' has the substantially same length as time period T in the printer 10.

In the printer 10 of this embodiment, the erasing route and the recording route are separately provided. Therefore, as shown in FIG. 1, at the same time as starting the printing step of printing information in one recording card 70 by the recording unit 50, the erasing step of erasing information of another recording card 70 is started at the erasing unit 30.

In other words, a process of a second cycle is started at time t5 shown in FIG. 6. Therefore, as shown in FIG. 7(A), two cycles, such as "the process of the first cycle and the process of the second cycle" or "the process of the second cycle and the process of the third cycle", are overlapped and processed in parallel. On the other hand, in the conventional printer, as shown in FIG. 7(B), a process of each cycle is processed without overlapping.

Accordingly, in the printer 10 of this embodiment, the printing step requiring the longest time and the paper feeding step through the step of conveying to the lifter are processed in parallel. Hence, it is possible to reduce the processing time compared to the conventional type printer. More specifically, as shown in FIG. 7(A) and FIG. 7(B), the processes of the second cycle and after are completed in half the time, namely T/2.

In addition, according to the printer 10 of this embodiment, the recording card 70 is conveyed from the erasing unit 30 through the recording unit 50 without being curved by the lifter 40. Accordingly, it is possible to convey the recording card 70 without damaging the RF tag 72 installed in the recording card 70.

Although a case where the RF tag 72 is installed in the recording card 70 is discussed in the above-mentioned embodiment, the present invention is not limited to this.

For example, an IC tag may be provided in the recording card and an IC tag reading device or the like may be provided at the conveyance tray 42 of the lifter 40. In this case, since the recording card is not curved in each step of the printer 10, it is possible to avoid the damage of the IC tag or the like.

In addition, in this embodiment, the RFID unit 48 is provided at the conveyance tray 42 of the lifter 40 so that the RFID unit 48 and the conveyance tray 42 are unified. Therefore, in parallel with the conveyance operations of the recording card 70, it is possible to read the information from the RF tag 72.

Furthermore, in a case where reading information from the recording card 70 is performed in the vicinity of the paper feeding cassette 21, a certain process may be required in order to avoid interference with the other recording card 70. In the printer of this embodiment, there is no need to consider the interference with the other recording card 70 received in the paper feeding cassette 21. Therefore, it is possible to avoid reading or writing error information from or to the RF tag so that stable reading and writing of the information can be performed.

In addition, there is no limitation of arranging the position of the RF tag 72 on the recording card 70.

Furthermore, although the conveyance tray 42 of the lifter 40 is moved from a conveying-in position indicated by a solid line in FIG. 1 to a conveying-out position indicated by a virtual line in this embodiment, the present invention is not limited to this.

Figure 8:
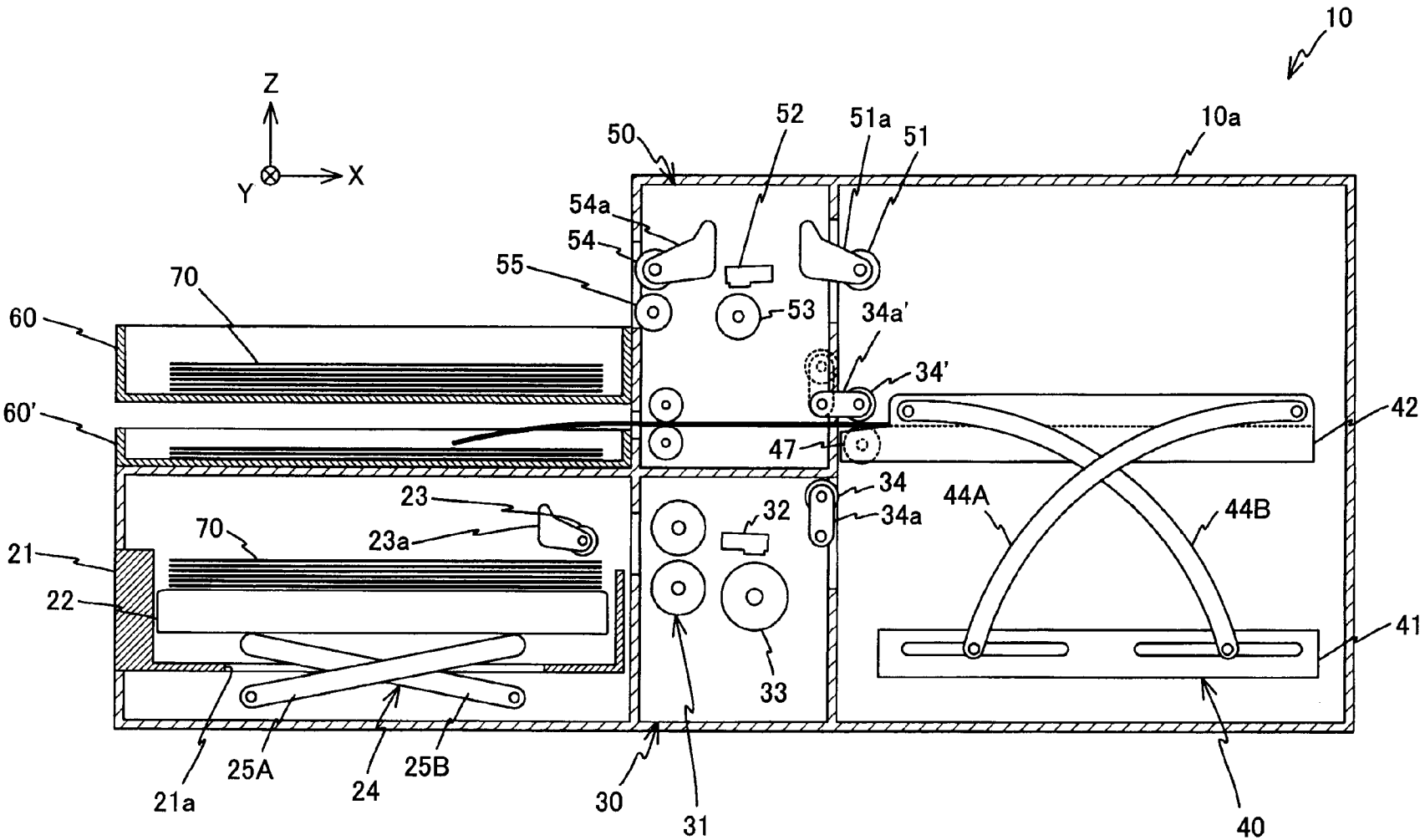
FIG. 8 is a schematic view for explaining a discharging position of the printer 10.

For example, as shown in FIG. 8, a discharging position for directly discharging the recording card 70 outside may be provided between the conveying-in position and the conveying-out position. In this case, for example, if the information of the recording card 70 cannot be read by the RFID unit 48, it is determined that the RF tag 42 be bad. In this case, it is possible to directly discharge the recording card 70 to the paper discharge tray 60' without the recording unit 50, with the conveyance roller 47 of the conveyance tray 42 and the movable roller 34' having the same function as the movable roller 34 supported by the movable member 34*a*.

In addition, although the conveyance tray 42 of the lifter 40 is lifted via two pairs of the link bars 44A and 44B in this embodiment, the present invention is not limited to this. For example, the recording card 70 may be conveyed by inclining the conveyance tray 42.

Figure 9:
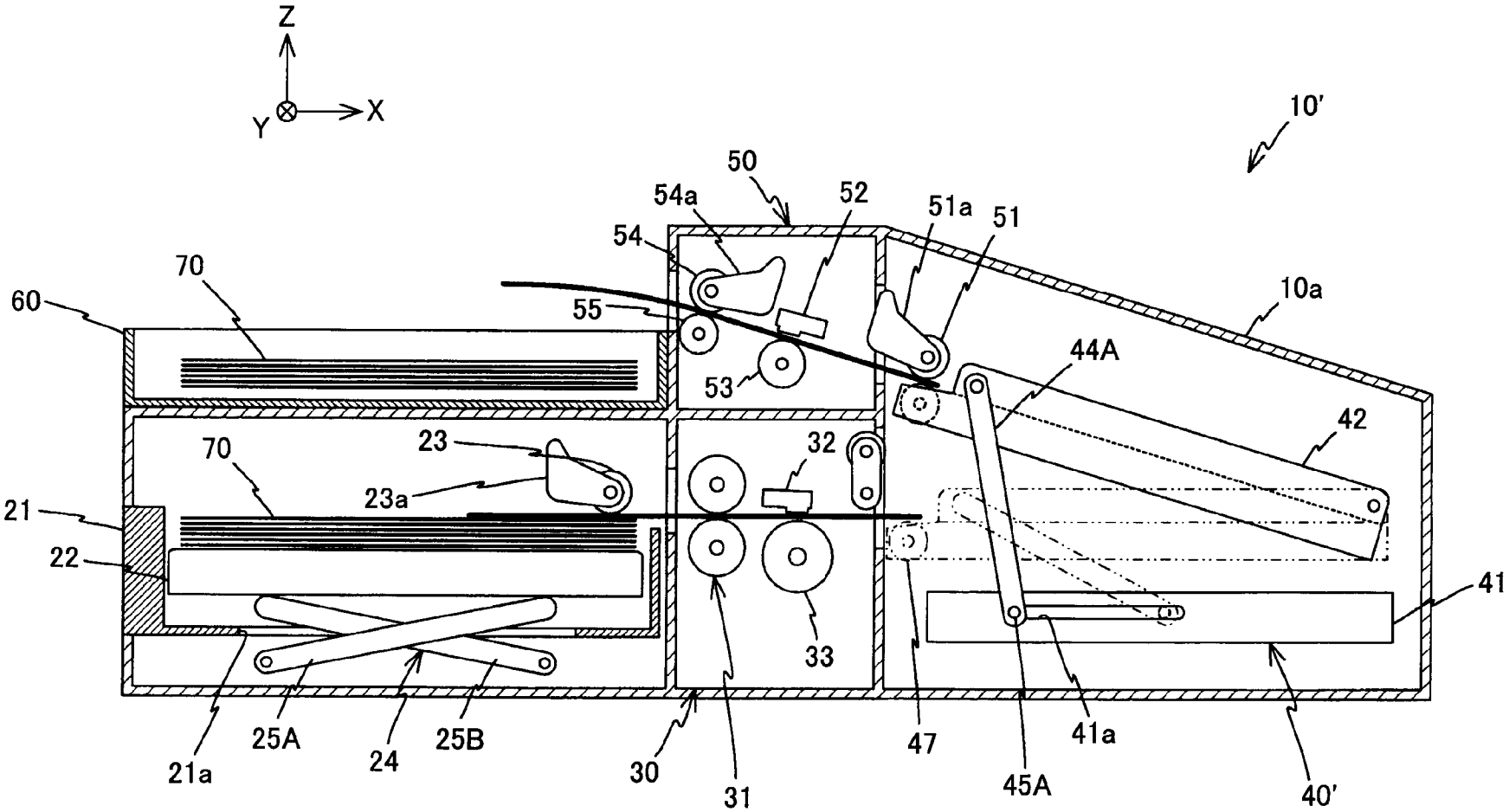
FIG. 9 is a schematic view of a printer 10' of a modified example of the embodiment of the present invention.

FIG. 9 is a schematic view of a printer 10' of a modified example of the embodiment of the present invention.

As show in FIG. 9, the +X side end part of the conveyance tray 42 of the lifter 40' is rotatably supported with respect to an axis parallel with the Y axis so that the conveyance tray 42 can be lifted and rotated via the link bar 44A. Because of this, when the recording card is conveyed in the conveyance tray 42 in the conveying-in position indicated by the virtual line in FIG. 9, the conveyance tray 42 is lifted and rotated by the lifting mechanism 31 to the conveyance position indicated by the solid line in FIG. 9 so that the recording card 70 can be conveyed out to the recording unit 50.

In this case, the moving area of the conveyance tray 42 of the lifter 40' is smaller than the moving area of the conveyance tray 42 of the lifter 40. Therefore, it is possible to make the size of the apparatus small.

A case where printing information in the recording card 70 is performed by the printer 10 is discussed in this embodiment. However, as long as the paper is thermo-sensitive even if the paper does not have the RF tag, the printer can erase and print the information.

In addition, although the recording unit 50 is provided above the erasing unit 30 in the printer 10 of this embodiment, the present invention is not limited to this.

For example, the erasing unit 30 may be provided above the recording unit 50. Both the erasing unit 30 and the recording unit 50 may be arranged in a horizontal direction so as to neighbor each other. In other words, the insertion opening for inserting the recording card 70 in the erasing unit 30 and the discharging opening for discharging the recording card 50 from the recording unit 50 may be arranged at one side so that full front operations of the apparatus can be realized.

Furthermore, the temperature characteristic of the recording card 70 shown in FIG. 3 is just an example. The recording card 70 may have a characteristic different from that shown in FIG. 3. In this case, it is possible to correspond to this by properly setting the heating temperature at the recording unit 50 or the erasing unit 30.

According to the embodiments of the present invention, it is possible to provide an information recording and erasing apparatus configured to record information on and erase other information from a thermo-sensitive recording medium which medium is capable of heat-reversible coloring and discoloring, the information recording and erasing apparatus including an erasing unit configured to move the thermo-sensitive recording medium from one side to another side, heat the thermo-sensitive recording medium, and erase the other information recorded in the thermo-sensitive recording medium; and a recording unit provided in a direction perpendicular to a moving direction of the thermo-sensitive recording medium with the erasing unit, the recording unit being configured to record the information in the thermo-sensitive recording medium where the other information is erased by the erasing unit.

The recording unit may move the thermo-sensitive recording medium from the other side to the one side so as to record the information on the thermo-sensitive recording medium.

The information recording and erasing apparatus may further include a conveyance system configured to convey the thermo-sensitive recording medium, where the other information is erased by the erasing unit, from the erasing unit to the recording unit.

The conveyance system may include a conveyance tray where the thermo-sensitive recording medium discharged to the other side of the erasing unit is mounted, and the thermo-sensitive recording medium may be conveyed from the other side of the erasing unit to the other side of the recording unit without curving, by driving the conveyance tray.

The conveyance system may lift the conveyance tray so that the thermo-sensitive recording medium is conveyed from the other side of the erasing unit to the other side of the recording unit without curving, by driving the conveyance tray.

The conveyance system may be rotated with respect to an axis situated perpendicular to a moving direction of the thermo-sensitive recording medium, so that the thermo-sensitive recording medium is lifted and conveyed from the other side of the erasing unit to the other side of the recording unit without curving, by driving the conveyance tray.

Recording the information in the thermo-sensitive recording medium by the recording unit may be performed after erasing the other information from the thermo-sensitive recording medium by the erasing unit is completed.

At least a part of recording the information in the thermo-sensitive recording medium by the recording unit and erasing the other information from the thermo-sensitive recording medium by the erasing unit may be performed in parallel.

The thermo-sensitive recording medium may include a tag where information can be read and written by a radio wave; and the information recording and erasing apparatus may further include a processing device configured to perform at least one of reading from and writing on the tag during conveyance of the thermo-sensitive recording medium by the conveyance system.

The tag may be an RF tag, and the processing device may be an RFID unit.

Reading the information from or writing the information to the tag may be performed with a tag of the thermo-sensitive recording medium conveyed by the conveyance system.

The conveyance system may discharge the thermo-sensitive recording medium to an outside without conveying the thermo-sensitive recording medium to the recording unit in a case where a process of reading or writing the information by the processing device is in error.

According to the embodiments of the present invention, the thermo-sensitive recording medium is moved from one side to another side. The recording unit is provided in a direction perpendicular to a moving direction of the thermo-sensitive recording medium with the erasing unit configured to erase information on the thermo-sensitive recording medium.

Therefore, without making the size of the apparatus large, it is possible to arrange the supply opening for supplying the thermo-sensitive recording medium to the erasing unit and the discharge opening for discharging the thermo-sensitive recording medium from the recording unit close to each other. Hence, it is possible to improve the operability of the apparatus.

In addition, since the erasing process and the recording process can be performed in parallel by the erasing unit and the recording unit, it is possible to improve the processing speed of the apparatus.

Thus, the information recording and erasing apparatus of the embodiments of the present invention is proper for recording and erasing information on or from the thermo-sensitive recording medium.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

This patent application is based on Japanese Priority Patent Application No. 2006-244311 filed on Sep. 8, 2006, the entire contents of which are hereby incorporated by reference.

What is claimed is:

1. An information recording and erasing apparatus configured to record information on and erase other information from a thermo-sensitive recording medium which medium is capable of heat-reversible coloring and discoloring, the information recording and erasing apparatus comprising:

an erasing unit configured to move the thermo-sensitive recording medium from a first side of the erasing unit to a second side of the erasing unit, heat the thermo-sensitive recording medium, and erase the other information recorded in the thermo-sensitive recording medium;

a recording unit provided in a direction perpendicular to a moving direction of the thermo-sensitive recording medium with the erasing unit, the recording unit having a first side and a second side and being configured to record the information in the thermo-sensitive recording medium where the other information is erased by the erasing unit; and a conveyance system including a conveyance tray where the thermo-sensitive recording medium discharged to the second side of the erasing unit is mounted, wherein the thermo-sensitive recording medium is conveyed from the second side of the erasing unit to the second side of the recording unit without curving, by driving the conveyance tray.

2. The information recording and erasing apparatus as claimed in claim 1, wherein the recording unit moves the thermo-sensitive recording medium from the second side of the recording unit to the first side of the recording unit so as to record the information on the thermo-sensitive recording medium.

3. The information recording and erasing apparatus as claimed in claim 1, wherein the conveyance system lifts the conveyance tray so that the thermo-sensitive recording medium is conveyed from the second side of the erasing unit to the second side of the recording unit without curving, by driving the conveyance tray.

4. The information recording and erasing apparatus as claimed in claim 1, wherein the conveyance system is rotated with respect to an axis situated perpendicular to a moving direction of the thermo-sensitive recording medium, so that the thermo-sensitive recording medium is lifted and conveyed from the second side of the erasing unit to the second side of the recording unit without curving, by driving the conveyance tray.

5. The information recording and erasing apparatus as claimed in claim 1, wherein recording the information in the thermo-sensitive recording medium by the recording unit is performed after erasing the other information from the thermo-sensitive recording medium by the erasing unit is completed.

6. An information recording and erasing apparatus configured to record information on and erase other information from a thermo-sensitive recording medium which medium is capable of heat-reversible coloring and discoloring, the information recording and erasing apparatus comprising:

an erasing unit configured to move the thermo-sensitive recording medium from one side to another side, heat the thermo-sensitive recording medium, and erase the other information recorded in the thermo-sensitive recording medium; and a recording unit provided in a direction perpendicular to a moving direction of the thermo-sensitive recording medium with the erasing unit, the recording unit being configured to record the information in the thermo-sensitive recording medium where the other information is erased by the erasing unit, wherein at least a part of recording the information in the thermo-sensitive recording medium by the recording unit and erasing the other information from the thermo-sensitive recording medium by the erasing unit is performed in parallel at a same time.

7. An information recording and erasing apparatus configured to record information on and erase other information from a thermo-sensitive recording medium which medium is capable of heat-reversible coloring and discoloring, the information recording and erasing apparatus comprising:

an erasing unit configured to move the thermo-sensitive recording medium from one side to another side, heat the thermo-sensitive recording medium, and erase the other information recorded in the thermo-sensitive recording medium;

a recording unit provided in a direction perpendicular to a moving direction of the thermo-sensitive recording medium with the erasing unit, the recording unit being configured to record the information in the thermo-sensitive recording medium where the other information is erased by the erasing unit;

a conveyance system configured to convey the thermo-sensitive recording medium, where the other information is erased by the erasing unit, from the erasing unit to the recording unit; and a processing device configured to perform at least one of reading from and writing on the thermo-sensitive recording medium during conveyance of the thermo-sensitive recording medium by the conveyance system, the processing device performing the at least reading from and writing on in one of a plurality of operational methods, wherein the thermo-sensitive recording medium includes a tag where information can be read and written by a radio wave, and the plurality of operational methods includes continuously and plural operations.

8. The information recording and erasing apparatus as claimed in claim 7, wherein the tag is an RF tag, and the processing device is an RFID unit.

9. The information recording and erasing apparatus as claimed in claim 7, wherein reading the information from or writing the information to the tag is performed with a tag of the thermo-sensitive recording medium conveyed by the conveyance system.

10. An information recording and erasing apparatus configured to record information on and erase other information from a thermo-sensitive recording medium which medium is capable of heat-reversible coloring and discoloring, the information recording and erasing apparatus comprising:

an erasing unit configured to move the thermo-sensitive recording medium from one side to another side, heat the thermo-sensitive recording medium, and erase the other information recorded in the thermo-sensitive recording medium;

a recording unit provided in a direction perpendicular to a moving direction of the thermo-sensitive recording medium with the erasing unit, the recording unit being configured to record the information in the thermo-sensitive recording medium where the other information is erased by the erasing unit; and a conveyance system configured to convey the thermo-sensitive recording medium, where the other information is erased by the erasing unit, from the erasing unit to the recording unit, wherein the thermo-sensitive recording medium includes a tag where information can be read and written by a radio wave, the information recording and erasing apparatus further includes a processing device configured to perform at least one of reading from and writing on the tag during conveyance of the thermo-sensitive recording medium by the conveyance system, and the conveyance system discharges the thermo-sensitive recording medium to an outside without conveying the thermo-sensitive recording medium to the recording unit in a case where a process of reading or writing the information by the processing device is in error.

11. An information recording and erasing apparatus configured to record information on and erase other information from a thermo-sensitive recording medium which medium is capable of heat-reversible coloring and discoloring, the information recording and erasing apparatus comprising:

an erasing unit configured to move the thermo-sensitive recording medium from a first side of the erasing unit to a second side of the erasing unit, heat the thermo-sensitive recording medium, and erase the other information recorded in the thermo-sensitive recording medium;

a recording unit provided in a direction perpendicular to a moving direction of the thermo-sensitive recording medium with the erasing unit, the recording unit having a first side and a second side and being configured to record the information in the thermo-sensitive recording medium where the other information is erased by the erasing unit; and a conveyance system configured to convey the thermo-sensitive recording medium from the second side of the erasing unit to the second side of the recording unit without curving.

* * * * *